United States Patent [19]

Brass

[11] Patent Number: 4,646,459

[45] Date of Patent: Mar. 3, 1987

[54] FIREARM WITH TILTABLE BARREL

[75] Inventor: Walter Brass, Blaubeuren, Fed. Rep. of Germany

[73] Assignee: H. Krieghoff GmbH, Ulm/Donau, Fed. Rep. of Germany

[21] Appl. No.: 762,546

[22] Filed: Aug. 2, 1985

[51] Int. Cl.[4] ..... F41C 15/00

[52] U.S. Cl. ..... 42/47; 42/46

[58] Field of Search ..... 42/46, 47

[56] References Cited

U.S. PATENT DOCUMENTS 715,903 12/1902 Torkelson ..... 42/47

2,108,130 2/1938 Lewis ..... 42/47

*Primary Examiner*—Deborah L. Kyle

*Assistant Examiner*—Ted L. Parr

*Attorney, Agent, or Firm*—Karl F. Ross; Herbert Dubno

[57] ABSTRACT

A firearm with a barrel tiltable about a breechblock includes an ejector for throwing out a cartridge or cartridge case. The ejector is prestressed by a spring so as to be movable in discharge direction and cooperates with a locking pin such that in a first stage the movement of the ejector during initial tilting of the barrel is braked and is brought to a standstill while upon further tilting of the barrel, the ejector is accelerated in a second stage to expel the cartridge.

18 Claims, 4 Drawing Figures

FIREARM WITH TILTABLE BARREL

FIELD OF THE INVENTION

My present invention relates to firearms with barrels tiltable about a breechblock and, in particular, is concerned with an ejector for throwing out cartridges or cartridge cases from the barrel, e.g. from the barrel upon "breaking open" a shotgun to permit reloading.

BACKGROUND OF THE INVENTION

In general, such firearms make use of ejectors arranged in guides and acted upon by springs so as to be movable in a discharge direction of the cartridge and retractable against the force of the spring by a suitable abutment of the breechblock.

The firearms equipped with such ejectors require special adjustments and equipment for the breech mechanism. This causes problems in case it is desired to subsequently equip a firearm with such an ejector as not only the barrel must be modified but also the breech mechanism.

Furthermore, firearms with tiltable barrels are known which are equipped with common dischargers for the cartridges. These dischargers push the cartridges during opening of the weapon only to such an extent that the cartridge can manually be seized and removed.

A fully automatic and complete ejection without manual intervention is not provided. In such firearms, the discharger which extends in longitudinal grooves at the barrel is actuated by a tappet which is arranged at the breechblock and pushes the discharger backwards during the opening of the weapon so that the cartridge or cartridge case is necessarily carried along out of the barrel. When the weapon is closed again, an abutment at the breech face of the breechblock forces the discharger again into its initial position until it is aligned with the barrel end adjacent to the breechblock.

OBJECT OF THE INVENTION

It is the principal object of my present invention to provide a breech-break firearm with an ejector for automatically allowing complete discharge of a cartridge and with such an ejector which can easily be subsequently built-in without necessitating any modifications of the breech mechanism.

SUMMARY OF THE INVENTION

I realize this object according to the invention by providing the firearm with a movable and prestressed ejector which is arranged at the barrel or throwing out a cartridge or the like and cooperates with a locking pin in such a manner that during a first stage of tilting of the barrel relative to the stock the movement of the ejector is braked until at the end of said first stage said ejector is locked while in a second stage upon further tilting of said barrel the ejector is allowed to accelerate in an unimpeded manner.

The ejector is provided with a pair of indexing formations or recesses arranged successively in discharge direction and separated by a lock cam which is an integral part of the ejector and faces the locking pin. The recesses are provided with different depths so that the locking pin is in frictional contact with the ejector when projecting into the flatter or shallower recess while being out of contact when projecting into the deeper recess. Thus, in the first stage, the ejector is braked as the locking pin slides along the flatter recess until the lock cam abuts the locking pin.

The second stage is initiated by a tappet which is connected to the breechblock and which upon sufficient tilting of the barrel pushes the ejector in discharge direction until the lock cam slips over the locking pin at which point the ejector accelerates unimpeded by the force of the spring prestressing the ejector to throw out the cartridge or cartridge case.

The ejector according to the invention has the advantage that it can easily be subsequently installed in a firearm without any modification of the breech mechanism by simply exchanging the barrel. Moreover, the design allows an alteration of the ejector into a common discharger by simply removing the ejector spring and the locking pin in case such should be desired.

Preferably, the ejector has two shanks guided at both sides of the barrel in respective grooves whereby each shank cooperates with a respective locking pin. In addition, the ejector is provided with a stop member to limit its movement in discharge direction.

BRIEF DESCRIPTION OF THE DRAWINGS

The above and other objects, features and advantages of the present invention will become more readily apparent from the following description, reference being made to the accompanying drawing in which.

SPECIFIC DESCRIPTION

Figure 1:
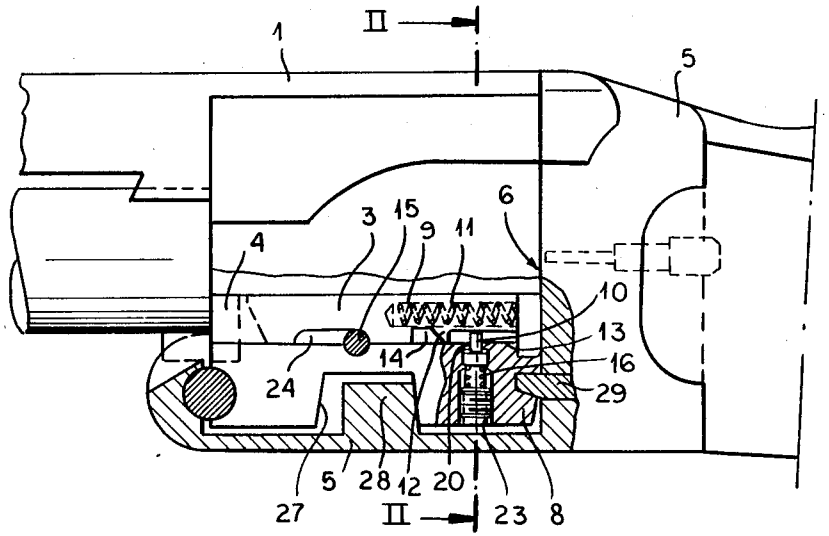
FIG. 1 is a side view of a portion of a firearm according to the invention illustrating a barrel and a breechblock in closed position of the firearm.

In the drawing, I have shown a firearm including a barrel 1 which is only partially illustrated and is provided with a barrel lug 8 at its rear portion to cooperate with a breechblock 5. The barrel 1 defines for a projectile (not shown), a bore 7 which can be accessed or sealed by means of the breechblock 5 when tilting the barrel 1 via a hinge 25 with respect to the breechblock 5, i.e. upon "breaking" the breech.

In the vicinity of the hinge 25, the breechblock 5 which is also only partially shown in the drawing is connected with a tappet 4 whose purpose will be described hereinafter and carries the stock and shoulder rest not specifically shown.

The barrel lug 8 is provided with cutouts 26, 27 which are engageable with latches 28, 29 of the breechblock 5. When being in a closed position, the latches 28, 29 project into the cutouts 26, 27 so that the breech face 6 of the breechblock 5 is in tight contact with the barrel 1 and seals the bore 7. I may note that the latch 29 is movably arranged within the breechblock 5 to allow disengagement from the associated cutout 26 when tilting the breechblock 5 into the open position of the firearm. To facilitate the engagement and disengagement of the latch 29 and the cutout 26, the barrel lug 8 is provided with a sloping surface 30.

Arranged at each side of the barrel 1 is a groove 2 accommodating a shank of an ejector 3 which is movable in axial direction to automatically throw out an empty cartridge case or unfired cartridge from the barrel 1 as will be described hereinbelow.

The ejector 3 is provided with an end portion 31 extending transversely to the elongation of the grooves 2 and engageable in a cutout 32 of the barrel lug 8 when aligning the breechblock 5 with the barrel 1, i.e. upon closing the firearm. Acting upon the end portion 31 of the ejector 3 is an ejector spring 11 which preferably is formed by two helical springs prestressing the ejector 3 in discharge direction of the cartridge. Each spring 11 is located in a blind bore 9 within the barrel 1 and extends parallel to the groove 2 and thus parallel to the ejector 3. At its surface facing the barrel lug 8, the ejector 3 is provided with recesses 13, 14 arranged successively in discharge direction and defining two sections separated from each other by a nose-like lock cam 12 which is an integral part of the ejector 3 and projects towards the facing surface of the barrel lug 8.

Figure 2:
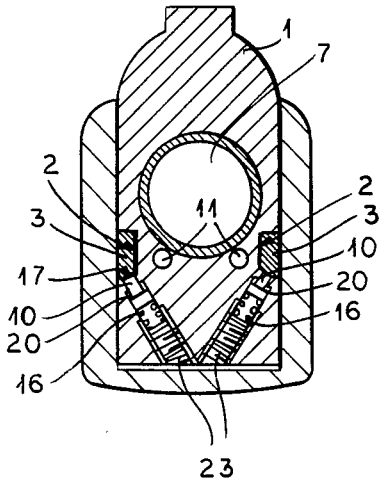
FIG. 2 is a is a cross sectional view of the firearm of FIG. 1 taken along line II—II in FIG. 1.

Extending perpendicularly to each shank of the ejector 3 is a locking pin 10 which is inserted in a borehole 23 within the barrel lug 8. As illustrated in FIG. 2, the locking pins 10 are arranged at an angle to each other to define a V-shaped configuration and each is prestressed by a spring 16 which forces the forward end 17 of the pin 10 to project into the recesses 13, 14.

Figure 3:
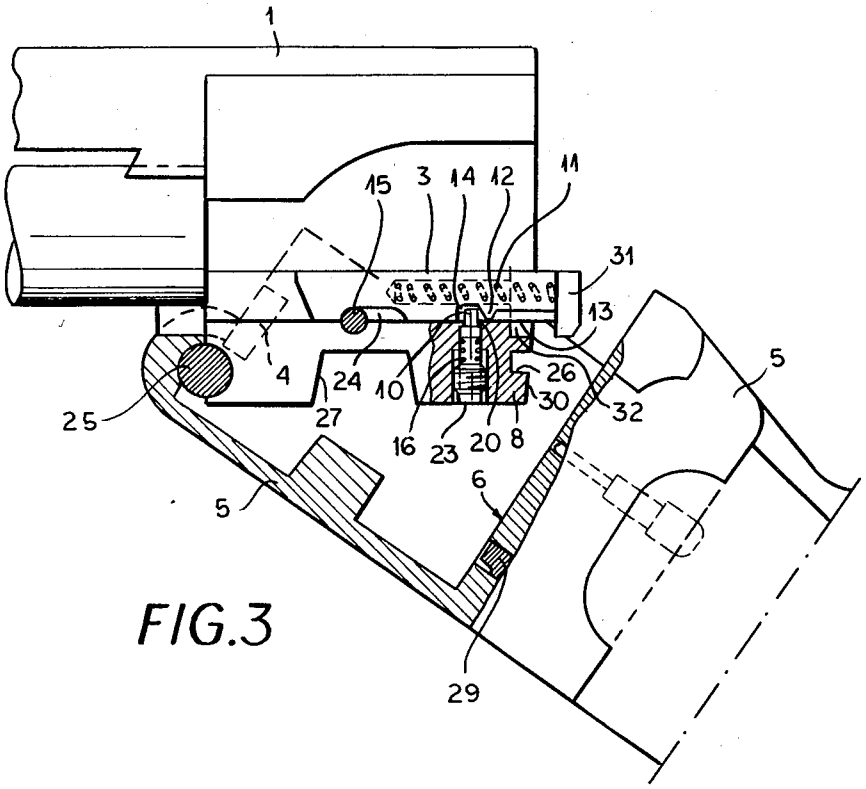
FIG. 3 is a side view of the firearm of FIG. 1 illustrating the barrel and the breechblock in open position of the firearm.

The boreholes 23 are step-shaped so that shoulders 20 are provided by the barrel lug 8 against which the locking pins 10 are forced by the respective springs 16 so as to limit the projection of the locking pins 10 into the recesses 13, 14. As can be seen from FIGS. 1 and 3, the recesses 13, 14 are so dimensioned that the forward end 17 of each locking pin 10 is in frictional contact with the bottom 18 of the recess 13 while arranged at a distance to the bottom 19 of the recess 14 as the shoulder 20 prevents a further projection of the locking pin 10. The recess 13 thus has a considerably smaller depth than the recess 14 so that no contact is obtained between the ejector 3 and the forward end of the locking pin 10 when the latter projects into the recess 14.

Figure 4:
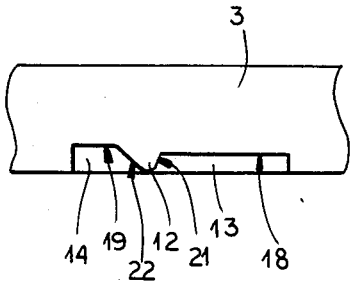
FIG. 4 is a partial illustration on an enlarged scale of an ejector of the firearm.

FIG. 4 shows on an enlarged scale the lock cam 12. Accordingly, the lock cam 12 is provided with two inclined cam flanks 21, 22 defining respective control surfaces along which the forward end 17 can move to allow the lock cam 12 to slide over the locking pin 10 by pushing the latter against the force of the spring 16. In order to facilitate the displacement of the locking pins 10, the forward end 17 thereof is provided with a rounded outer contour.

At an axially inward distance to the recess 14, the ejector 3 is provided with a further recess 24 in which a stop member 15 is arranged to limit the movement of the ejector 3 in axial direction.

After having described the individual parts of the firearm, its mode of operation will now be explained in more detail When the firearm or weapon is closed as shown in FIG. 1, the ejector 11 is prestressed by the spring 11 and its end portion 31 abuts against the breech face 6. By means of the spring 16, each locking pin 10 projects into the recess 13 with its forward end 17 contacting the bottom 18 while the stop member 15 is located at the rightmost end of recess 24.

During opening of the weapon, i.e. when tilting the barrel 1 relative to the breechblock 5, the ejector spring 11 forces the ejector 3 in discharge direction as the counterforce applied by the breech face 6 is removed Since the locking pin 10 slides with friction along the bottom 18 of the less deep recess 13, the displacement of the ejector 3 is decelerated until the lock cam 12 reaches the locking pin 10. The bottom 18 thus serves as a braking surface whereby the braking force is provided by the spring 16.

It is certainly possible to adjust the braking force, e.g. by altering the prestress of the spring. The pressure applied by the spring 16 prevents the lock cam 12 from slipping past the locking pin 10. Thus, the locking pin 10 provides a stop for the ejector 3 at the end of the first stage, i.e. first path section as defined by the recess 13.

Upon further tilting the barrel 1, the tappet 4 abuts the ejector 3 at its end facing the barrel 1 and slides the ejector 3 further in discharge direction thus forcing the lock cam 12 to slip over the locking pin 10 which is pushed downwardly by the cam flank 21 against the force of the spring 16. Thus, the locking pin 10 is brought out of contact with the ejector 3 as it projects into recess 14 after sliding along cam flank 19 so that a braking action as obtained during the first stage is prevented in the second stage, i.e. second path section as defined by the recess 14.

Consequently, in the second, path section, the ejector 3 is impelled or fired without braking and unimpeded in discharge direction by the spring 11 towards the rear until the stop member 15 occupies the leftmost position within the recess 25 and thus stops the movement of the ejector 3. In the present embodiment, the length of path during the second stage is about 4 mm.

The acceleration of the ejector 3 during the second stage is relayed to the cartridge or cartridge case which is thus sufficiently accelerated to be automatically discharged or thrown out from the barrel 1. I may note that the sliding of the locking pin 10 downwardly along the inclined cam flank 22 attributes to the acceleration of the ejector 3.

Upon closing the weapon again, the breech face 6 abuts against the end portion 31 and forces the ejector 3 against the force of the spring 11 in its initial position, i.e. in its tensioning position whereby the lock cam 12 is pushed backwardly so as to pass the locking pin 10 which is pressed in downward direction by the cam flank 22 and thereafter contacts the ejector 3 again as the forward end 17 rests against the bottom 18 of the recess 13.

I claim:

1. A firearm with a barrel tiltable about a breechblock, comprising:

an ejector accommodated within said barrel for throwing out a cartridge or the like and being movable between a first position in which said barrel is clsoed and a second position in which said barrel is open by tilting the latter about said breechblock;

resilient means exerting a force on said ejector for movng the latter in a discharge direction of the cartridge;

locking means cooperating with said ejector so that in a first stage of tilting of said barrel the movement of said ejector is braked until at the end of said first stage said ejector is locked against the force exerted by said resilient means thereon; and releasing means for pushing said ejector past said locking means upon further tilting of said barrel so that in a second stage said ejector is alowed to accelerate in a substantially unimpeded manner by the force of said resilient means, said locking means including a lock cam integrally connected with said ejector, a locking pin arranged in said barrel and extending perpendicularly to the discharge direction and a spring prestressing said locking pin so as to enable it to be movable towards said ejector, said locking pin cooperating with said lock cam in such a manner that the latter rests against said locking pin at the end of said first stage to stop the movement of said ejector in discharge direction, said releasing means including a tappet connected to said breechblock, said tappet abutting said ejector to force the latter out of its locked position at the end of said first stage and to allow said ejector to enter said second stage when said barrel is further tilted.

2. A firearm as defined in claim 1 wherein said ejector is provided with two recesses arranged successively in discharge direction and facing said locking pin, said recesses being separated from each other by said lock cam, said locking pin projecting into one of said recesses during said first stage such that its face is in frictional contact with said ejector while projecting into the other one of said recesses such that said end face of said locking pin extends at a distance to said ejector.

3. A firearm as defined in claim 2 wherein said one recess has a depth smaller than the depth of said other recess.

4. A firearm as defined in claim 2 wherein said barrel is provided with a borehole accommodating said locking pin, said borehole being step-shaped so as to define a shoulder which limits the projection of said locking pin into said other recess.

5. A firearm as defined in claim 1 wherein said tappet is constructed and arranged to move said lock cam past said locking pin against the force exerted by said spring onto said locking pin to initiate said second stage.

6. A firearm as defined in claim 1 wherein said breechblock has a breech face facing said barrel, said breech face sliding said ejector into its first position against the force of said resilient means.

7. A firearm as defined in claim 6 wherein said breech face causes said lock cam to slide past said locking pin upon returning of said ejector into its first position

8. A firearm as defined in claim 1 wherein said ejector has two shanks arranged in grooves extending at both sides of said barrel, each of said shanks of said ejector cooperating with a respective one of said locking means.

9. A firearm as defined in claim 8 wherein said resilient means includes a pair of helical springs accommodated within said barrel and extending parallel to said grooves.

10. A firearm as defined in claim 1, further comprising stop means for limiting the movement of said ejector during said second stage.

11. A firearm with a barrel tiltable about a breechblock, comprising:

an ejector accommodated within said barrel for throwing out a cartridge or the like an being movable between a first position in which said barrel is closed and a second position in which said barrel is open by tilting the latter about said breechblock;

resilient means exerting a force on said ejector for moving the latter in a discharge direction of the cartridge;

locking means cooperating with said ejector so that in a first stage of tilting of said barrel the movement of said ejector is braked until at the end of said first stage said ejector is locked against the force exerted by said resilient means thereon; and releasing means for pushing said ejector past said locking means upon further tilting of said barrel so that in a second stage said ejector is alllowed to accelerate in a substantially unimpeded manner by the force of said resilient means, said lcoking means including a lock cam integrally connected with said ejector, a locking pin arranged in said barrel and extending perpendicularly to the discharge direction and spring prestressing said locking poin so as to enable it to be movable towards said ejector, said locking pin cooperating with said lock cam in such a manner that the latter rests against said locking pin at the end of said first stage to stop the movement of said ejector in discharge direction, said lock cam being provided with inclind cam surfaces to facilitate the sliding of said lock cam past said locking pin.

12. A firearm as defined in claim 11 wherein said ejector is provided with two recesses arranged successively in discharge direction and facing said locking pin, said recesses being separated from each other by said lock cam, said locking pin projecting into one of said recesses during said first stage such that its face is in frictional contact with said ejector while projecting into the other one of saaid recesses such that said end face of said locking pin extends at a distance to said ejector.

13. A firearm as defined in claim 12 wherein said one recesshas a depth smaller than the depth of said other recess.

14. A firearm as defined in claim 11 wherein said breechblock has a breech face facing said barrel, said breech face sliding said ejector into its first position against the force of said resilient means.

15. A firearm as defined in claim 14 wherein said breech face causes said lock cam to slide past said locking pin upon returning of said ejector into its first position.

16. A firearm as definedd in claim 11 wherein said ejector has two shanks arranged in grooves extending at both sides of said barrel, each of said shanks of said ejector cooperating with a respective one of said locking means.

17. A firearm as defined in claim 16 wherein said resilient means includes a pair of helical springs accommodated within said barrel and extending parallel to said grooves.

18. A firearm as defined in claim 11, further comprising stop means for limiting the movement of said ejector during said second stage.

* * * * *